US011176582B2

(12) United States Patent
Moore

(10) Patent No.: US 11,176,582 B2
(45) Date of Patent: Nov. 16, 2021

(54) SYSTEMS AND METHODS FOR MULTI-TRACK PROCESSING OF INCOMING DATA EVENTS

(71) Applicant: MASTERCARD INTERNATIONAL INCORPORATED, Purchase, NY (US)

(72) Inventor: John Patrick Moore, St. Peters, MO (US)

(73) Assignee: MASTERCARD INTERNATIONAL INCORPORATED, Purchase, NY (US)

( * ) Notice: Subject to any disclaimer, the term of this patent is extended or adjusted under 35 U.S.C. 154(b) by 86 days.

(21) Appl. No.: 16/382,723

(22) Filed: Apr. 12, 2019

(65) Prior Publication Data

US 2020/0327588 A1 Oct. 15, 2020

(51) Int. Cl.
*G06Q 30/04* (2012.01)

(52) U.S. Cl.
CPC ..... *G06Q 30/04* (2013.01)

(58) Field of Classification Search
CPC ..... G06Q 20/40; G06Q 40/00; G06Q 20/28; G06Q 20/38; G06Q 20/02; G06Q 20/10; G06Q 20/20; G06Q 20/12
USPC ..... 705/39
See application file for complete search history.

(56) References Cited

U.S. PATENT DOCUMENTS

| | | | | |
|---|---|---|---|---|
| 10,121,208 | B2 | 11/2018 | Rojas | |
| 10,192,272 | B2 | 1/2019 | Morse et al. | |
| 10,546,287 | B2 * | 1/2020 | Monk | G06Q 20/20 |
| 10,586,234 | B2 * | 3/2020 | Mueller | G06Q 20/4016 |
| 2013/0282565 | A1 * | 10/2013 | Barta | G06Q 20/34 705/39 |
| 2016/0019657 | A1 | 1/2016 | Mande | |
| 2018/0218062 | A1 | 8/2018 | Verma et al. | |
| 2019/0005497 | A1 * | 1/2019 | Olliphant | G06Q 20/405 |
| 2019/0066202 | A1 | 2/2019 | Cervenka et al. | |

* cited by examiner

*Primary Examiner* — Olusegun Goyea
(74) *Attorney, Agent, or Firm* — Armstrong Teasdale LLP

(57) ABSTRACT

A computer-implemented for preparing a customer invoice using a computing system including at least one processor communicatively coupled to a memory device is provided. The method includes (i) receiving a batch file of usage data on a first schedule, wherein the first schedule repeats a plurality of times before a billing cycle ends, (ii) identifying a first set of usage events having a first characteristic, wherein the first characteristic requires that a per usage rule be applied to each of the first set, (iii) retrieving the first per usage rule from a memory device, (iv) applying the retrieved first per usage rule to each of the first set to generate modified usage events in accordance with the first schedule, (v) aggregating the modified usage events, and (vi) storing the aggregated modified usage events in the memory device in accordance with the first schedule for retrieval when the billing cycle ends.

22 Claims, 5 Drawing Sheets

SYSTEMS AND METHODS FOR MULTI-TRACK PROCESSING OF INCOMING DATA EVENTS

BACKGROUND

The present application relates generally to processing high volumes of raw data for report generation at the end of a cycle and, more specifically, to a system and method for reducing the volume of data required to generate a report at the end of a billing cycle.

In at least some known report generation systems, such as those used to invoice usage of a payment processing network, a raw stream of network usage events is first subjected to a data enrichment module, a customer guide module, and a billing event determination module. Each network usage event may be validated by the enrichment module. The customer guide module is utilized to determine, for each network usage event, which customer to bill for use of the network. For example, each network usage event may involve multiple parties to an underlying payment transaction, and the customer guide module can identify the one or more parties to be billed for each usage event. The billing event determination module applies rules to each usage event to identify one or more associated billing events. Each billing event for which a given usage event qualifies creates a new record during processing, thereby increasing the billable event count.

Some known business entities, such as a payment processing network, receive hundreds of millions of uses per day. In at least some known systems, resulting billing event data is routed to an aggregation module, which removes information unnecessary to the invoicing process from the raw usage data, and aggregates like billable events together based on key factors, such as by billing customer. Typical customer-specific billing rules, such as volume discounts, are applied to the aggregated data. Accordingly, the aggregation module nominally reduces the total number of billable transactions ready for billing.

However, many of these business entities now employ per-customer billing rules, such as a custom-specific maximum and/or a minimum charge for the underlying network transaction, which cannot be applied to post-aggregation data. Accordingly, usage events requiring application of these per-customer billing rules are not aggregated during the customer's billing cycle. Thus, on the designated bill run date, high volumes of unaggregated data that have accumulated over the customer's billing cycle must be retrieved and processed to generate an invoice. This creates a bottleneck in the invoice generation process at the end of the billing cycle that can delay the process and/or require a greatly increased amount of processing resources.

Accordingly, a system that factors in customer-specific billing rules applicable on a per usage basis prior to the end of a billing cycle, and additionally applies methods to speed up and reduce the computational resources needed for the billing process by avoiding bulk data volumes at the end of the billing process, would be useful.

BRIEF DESCRIPTION

In one aspect, a computer-implemented method for preparing a customer invoice using a computing system comprising at least one processor communicatively coupled to a memory device is provided. The computer-implemented method includes receiving, by the at least one processor, a batch file of usage data on a first schedule. The first schedule repeats a plurality of times before a billing cycle ends. The computer-implemented method further includes identifying, by the at least one processor, from the received batch file, a first set of usage events having a first characteristic. The first characteristic requires that a first per usage rule be applied to each usage event of the first set of usage events. The computer-implemented method also includes retrieving, by the at least one processor, the first per usage rule from the memory device. The computer-implemented method also includes applying, by the at least one processor, the retrieved first per usage rule to each of the first set of usage events to generate modified usage events in accordance with the first schedule. The computer-implemented method further includes aggregating, by the at least one processor, the modified usage events, wherein the aggregation reduces a number of modified usage events for billing. The computer-implemented method further includes storing, by the at least one processor, the aggregated modified usage events in the memory device in accordance with the first schedule for retrieval when the billing cycle ends.

In another aspect, a computing system for preparing a customer invoice is provided. The computing system includes a memory device for storing data and at least one processor communicatively coupled to the memory device. The at least one processor is programmed to receive a batch file of usage data on a first schedule. The first schedule repeats a plurality of times before a billing cycle ends. The at least one processor is further programmed to identify, from the received batch file, a first set of usage events having a first characteristic. The first characteristic requires that a first per usage rule be applied to each usage event of the first set of usage events. The at least one processor is further programmed to retrieve the first per usage rule from the memory device. The at least one processor is also programmed to apply the retrieved first per usage rule to each of the first set of usage events to generate modified usage events in accordance with the first schedule. The at least one processor is also programmed to aggregate the modified usage events, wherein the aggregation reduces a number of modified usage events for billing. The at least one processor is also programmed to store the aggregated modified usage events in the memory device in accordance with the first schedule for retrieval when the billing cycle ends.

In yet another aspect, at least one non-transitory computer-readable storage media that includes computer-executable instructions for preparing a customer invoice is provided. When executed by a computing device including at least one processor coupled to a memory device, the computer-executable instructions cause the computing device to receive a batch file of usage data on a first schedule. The first schedule repeats a plurality of times before a billing cycle ends. The computer-executable instructions further cause the computing device to identify, from the received batch file, a first set of usage events having a first characteristic. The first characteristic requires that a first per usage rule be applied to each usage event of the first set of usage events. The computer-executable instructions further cause the computing device to retrieve the first per usage rule from the memory device. The computer-executable instructions further cause the computing device to apply the retrieved first per usage rule to each of the first set of usage events to generate modified usage events in accordance with the first schedule. The computer-executable instructions also cause the computing device to aggregate the modified usage events, wherein the aggregation reduces a number of modified usage events for billing. The computer-executable instructions also cause the computing device to store the aggregated modified usage events in the memory device in accordance with the first schedule for retrieval when the billing cycle ends.

BRIEF DESCRIPTION OF THE DRAWINGS

FIG. 1 is an example flow diagram illustrating data flow in an example prior art invoicing process utilized by a business entity, such as a payment processing network, to track customer network usage for invoice generation.

FIG. 2 is a flow diagram illustrating an example prior art invoice generation process for unaggregated billing events prior to a bill run, using the prior art process shown in FIG. 1.

FIG. 3 is a flow diagram illustrating the flow of data through an improved invoicing process, in which a preliminary analysis ("PA") process is utilized to process unaggregated billing events prior to normalization and rating.

FIG. 4 is a flow diagram illustrating an example invoice generation process that is improved by using preliminary analysis ("PA") process, as shown in FIG. 3.

FIG. 5 illustrates an example configuration of a server computing device configured to perform the invoicing process improved by the preliminary analysis ("PA") process, as shown in FIG. 3.

Figure 1:
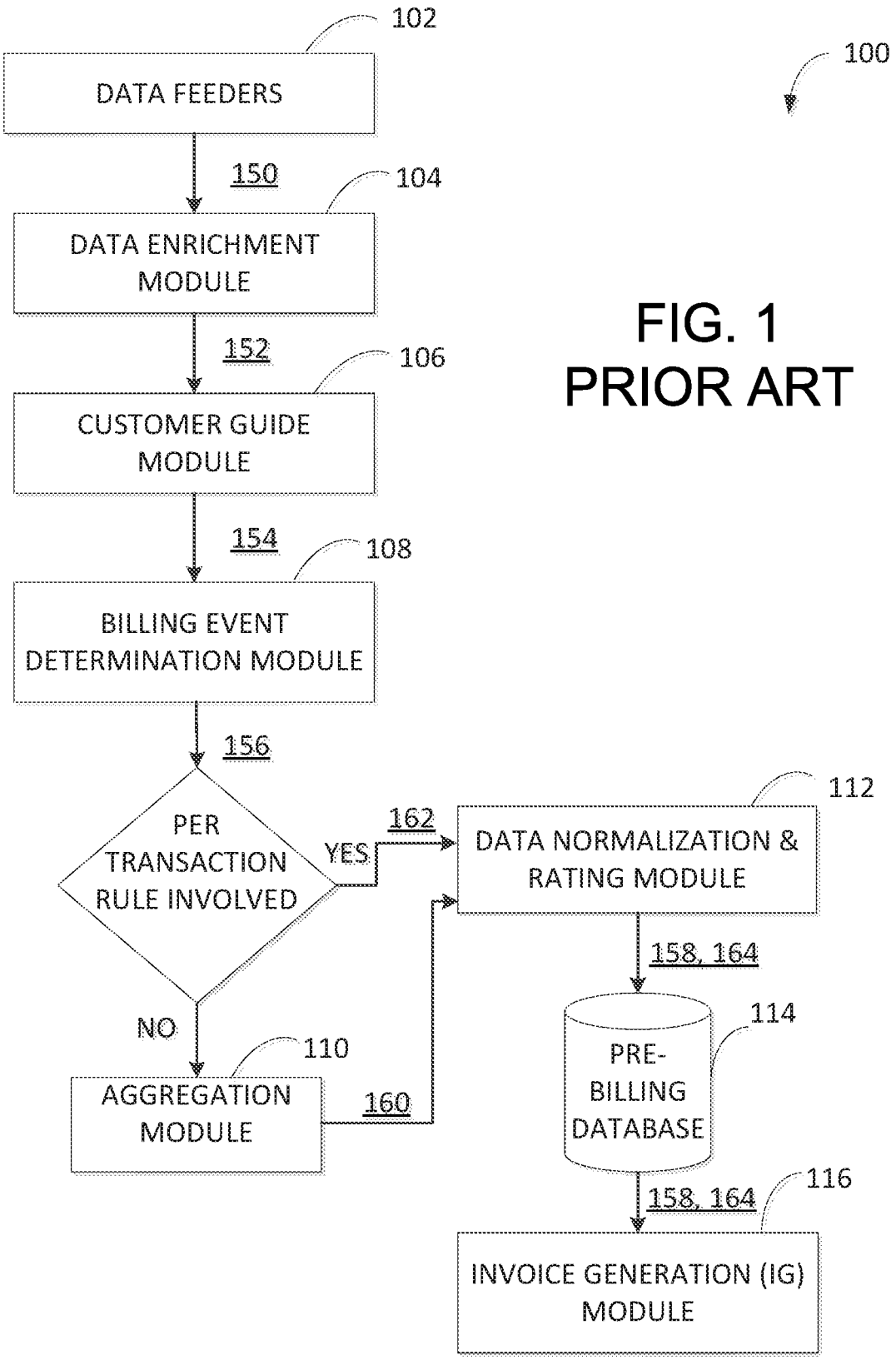
FIG. 1 PRIOR ART
FIGS. 1-5 show example embodiments of the methods and systems described herein.

Like numbers in the Figures indicate the same or functionally similar components. Although specific features of various embodiments may be shown in some figures and not in others, this is for convenience only. Any feature of any figure may be referenced and/or claimed in combination with any feature of any other figure.

DETAILED DESCRIPTION

The systems and methods according to this disclosure are directed to processing high volumes of network usage data that require customer-specific rules to be applied on a per usage event basis prior to generating an end of cycle report, such as a customer invoice.

Business entities, such as a payment processing network, employ an invoice generation system that enables the business entity to track data submitted over the network and associated with each customer, and generate invoices to bill customers for network usage at the end of each customer's billing cycle. The payment processing network can bill its customers, such as financial institutions (e.g., issuers and acquirers) and merchants for services provided to the customers. For example, the payment processing network may charge customers for fraud protection services. In particular, customers of the payment processing network generate high volumes of usage data over the network that trigger multiple different types of billing events. For example, one underlying payment transaction completed over the network might generate as many as 20 different billing events for the financial institutions and merchants.

For business entities that receive and process high volumes of network data on a daily basis, managing the network usage data over the course of a customer's billing cycle involves filtering through substantial volumes of data that need to be analyzed and processed for billing. For example, if a payment processing network receives a series of authorization request and response messages, clearing messages, and settlement messages each time cardholders uses their cards to make a purchase, the payment processing network receives significant volumes of data that require processing based on complex billing structures and various pricing agreements in place between the payment processing network and its customers (e.g., merchants, issuers, acquirers).

A business entity can bill its customers based on a weekly or monthly volume of network usage by the customer, for example. The invoice generation system accesses stored network usage data for the customer, and processes the data to determine pertinent invoicing information, such as, for example, which customer(s) to bill, what services to bill for, and what rates to apply. In one embodiment, the invoice generation system may generate an invoice for a week's worth of payment card transactions submitted by an issuer and/or an acquirer. In another embodiment, the invoice generation system may generate an invoice for fraud detection services provided to a financial institution, such as an acquirer or an issuer, based on a weekly volume of accumulated network usage data.

In the example embodiment, the invoice generation system implements an improved invoicing process. The improved invoicing process includes an invoice preparation process that executes a preliminary analysis ("PA") process on a first schedule that occurs more than once during a customer's billing cycle, and an invoice generation process (e.g., the bill run) that occurs at the end of the billing cycle (e.g., on the customer's designated bill run date). The invoice preparation process is performed by data feeders, a data enrichment module, a customer guide module, a billing event determination module, an aggregation module, and a data normalization and rating module. The invoice preparation process, including the PA process, is performed each time data feeders receive a batch of raw network usage data. The data feeders receive raw network usage data according to a first schedule (e.g., hourly, daily, or weekly basis) that repeats more than once within each period of a second schedule, or billing cycle, for invoice generation/billing. Raw usage data subject to per-usage billing rules is processed during the invoice preparation process to generate billing events that are normalized, rated, and stored in the pre-billing database, waiting to be retrieved on the designated bill run date for bill run. Thus, the PA process reduces or eliminates the processing bottleneck in prior art systems created by the application of per-usage customer rules at the bill run date for invoice generation.

The invoice generation system also includes an invoice generation ("IG") module, which is configured to perform the invoice generation process on a designated bill run date scheduled for customer invoicing. On the designated bill run date, the IG module retrieves the stored billing events from the pre-billing database to apply bulk rules to the retrieved billing events and generate an invoice(s) to send to customer(s). Invoices are generated on a second schedule, such as on a daily, weekly, and/or monthly basis, for example, depending on the customer's billing cycle. Thus, on the designated bill run date, billing events stored for a customer's entire billing cycle are retrieved by the IG module from the pre-billing database. For example, if the customer's billing cycle is 7 days, the IG module retrieves billing events generated over a span of 7 days from the pre-billing database to generate a customer invoice.

Unlike conventional invoice generation systems, which cannot aggregate usage events requiring usage event-specific rules (e.g., a per usage rule, "PUR") according to the first schedule prior to the bill run, the PA process enables these specific types of usage events to be processed and aggregated according to the first schedule, such as each time a batch of raw network usage data is received by the system, thereby reducing (i) the volume of network usage data stored throughout the billing cycle, and (ii) the volume of usage data processed at the end of the billing cycle.

In the example embodiment, the invoice generation system receives batch files of customer network usage data from data feeders. A data enrichment module, a customer guide module, and a billing event determination ("BED") module are utilized to extract usage events from the batch files, identify the appropriate customer(s) to be billed for each usage event, and apply highly configurable rules to generate billing events based on the services performed for each usage event. Each billing event that a usage event qualifies for creates a new record during processing.

In the example embodiment, if the enhanced invoice generation system determines that one or more billing events involve a PUR, the system routes the events to the PA process, which applies the PUR to the applicable billing events. The PA process is implemented by a preliminary analysis ("PA") module, a per usage rules ("PUR") database, a preliminary analysis ("PA") aggregation module, and a data formatter module. In the example embodiment, upon determining that one or more billing events involves a PUR, the unaggregated billing events generated by the BED module are transmitted to the PA module. The PA module is configured to determine the type of PUR involved for each unaggregated billing event. The PA module retrieves the customer-specific PURs from the PUR database, and applies the retrieved PURs to the unaggregated billing events received from the BED module to generate modified billing events ("MBEs") for normalization and rating.

In one example, a customer-specific PUR may require that a maximum and/or minimum dollar amount be applied for a specific type of network usage (e.g., credit card transactions associated with a specific merchant). In this example, the PUR may require that specific types of payment transactions associated with this merchant be assessed on a transaction by transaction basis to verify that the transaction amount for each transaction is within the established maximum and/or minimum dollar amount. The PUR may further establish that if the transaction amount is outside the bounds of the established maximum and/or minimum dollar amount, to change the transaction amount to a fixed dollar amount within the established range to ensure that this customer-specific requirement is met. In this example, these types of usage events cannot be aggregated with other usage events because the PUR needs to be applied to verify the limits of each qualifying event individually.

Because the PA process enables one or more customer-specific PURs to be applied prior to the bill run, the MBEs on the PA processing track can subsequently undergo a separate, dedicated aggregation process during the invoice preparation process to reduce the total number of MBEs to be billed. The aggregated MBEs can be normalized and rated during the PA process, and subsequently stored in the pre-billing database. The aggregated MBEs can also be formatted as a rating file and transmitted to the data normalization and rating module to be normalized and rated.

Accordingly, unlike conventional invoicing processes, the PA process described herein enables usage events subject to a PUR to be aggregated separately from traditional usage events, and to subsequently be normalized and rated prior to being stored in the pre-billing database. This specifically reduces the volume of usage data required to undergo a normalization and rating process for those usage events subject to a PUR. In conventional systems, by contrast, usage events subject to a PUR are normalized and rated in an unaggregated state, thereby resulting in a significantly higher volume of usage data to be normalized, rated, and stored.

By utilizing the PA process to apply PURs to qualifying billing events during the invoice preparation process each time raw network usage data is received by data feeders, the volume of data that (i) undergoes a normalization and rating process, (ii) is stored in the pre-billing database after each batch of raw network usage data is processed, (iii) is accumulated in the pre-billing database at the end of each billing cycle, and (iv) is retrieved for processing during a bill run is substantially reduced. Further, by applying the PA process, the invoice generation system subsequently avoids the resource-intensive application of PURs during the invoice generation process (e.g., bill run).

The invoice generation computing system described herein enables a business entity that receives hundreds of millions of uses per day, such as a payment processing network, to employ customer-specific billing rules (e.g., per usage rules) to each network usage event and aggregate like PUR-modified billable usage events, according to a first schedule (e.g., each time the business entity receives raw network usage data) that occurs multiple times within a billing cycle. This process implemented by the computing system is unconventional in that it enables PURs to be applied to raw data multiple times throughout a customer's billing cycle to reduce the volume of raw data stored for processing during a bill run (e.g., invoice generation process) at the close of a billing cycle.

The technical effects achieved by the systems and methods described herein include (i) reducing the volume of network usage data imported by the invoice generation system to perform a bill run at the end of a billing cycle, (ii) increasing the bill run processing speed by applying specific billing functionality, such as per usage rules, to applicable network usage events each time raw network usage data is managed, rather than performing all applicable billing rules during the bill run, (iii) reducing the amount of network resources and bandwidth needed to process high volumes of data at the end of the billing cycle (e.g., during a bill run), and (iv) reducing the potential for error by applying per usage rules ahead of the billing run, and by importing reduced volumes of network usage data for the bill run.

The methods and systems directed to the invoice generation computing system described herein may be implemented using computer programming or engineering techniques including computer software, firmware, hardware or any combination or subset thereof, wherein the technical effect may be achieved by performing at least one of the following steps: (a) receiving, by at least one processor a batch file of usage data on a first schedule, wherein the first schedule repeats a plurality of times before a billing cycle ends, (b) identifying, by the at least one processor, from the received batch file, a first set of usage events having a first characteristic, wherein the first characteristic requires that a per usage rule be applied to each usage event of the first set of usage events, (c) retrieving, by the at least one processor, the per usage rule from the memory device, (d) applying, by the at least one processor, the retrieved per usage rule to each usage event of the first set of usage events in accordance with the first schedule, (e) aggregating, by the at least one processor, the modified usage events to reduce a number of modified usage events for billing, and (f) storing, by the at least one processor, the aggregated usage events in the memory device for retrieval when the billing cycle ends.

In one embodiment, a computer program is provided, and the program is embodied on a computer-readable medium.

In an example embodiment, the system is executed on a single computer system, without requiring a connection to a server computer. In a further example embodiment, the system is being run in a Windows® environment (Windows is a registered trademark of Microsoft Corporation, Redmond, Wash.). In yet another embodiment, the system is run on a mainframe environment and a UNIX® server environment (UNIX is a registered trademark of X/Open Company Limited located in Reading, Berkshire, United Kingdom). In a further embodiment, the system is run on an iOS® environment (iOS is a registered trademark of Cisco Systems, Inc. located in San Jose, Calif.). In yet a further embodiment, the system is run on a Mac OS® environment (Mac OS is a registered trademark of Apple Inc. located in Cupertino, Calif.). In still yet a further embodiment, the system is run on Android® OS (Android is a registered trademark of Google, Inc. of Mountain View, Calif.). In another embodiment, the system is run on Linux® OS (Linux is a registered trademark of Linus Torvalds of Boston, Mass.). The application is flexible and designed to run in various different environments without compromising any major functionality. The following detailed description illustrates embodiments of the disclosure by way of example and not by way of limitation. It is contemplated that the disclosure has general application to providing a computer-implemented method for reducing the data volume, processing speed, and bandwidth involved in a report generation process (e.g., a bill run) when one or more usage events require that a rule be applied on a per usage basis, thus providing an alternative to the known invoicing process.

As used herein, an element or step recited in the singular and preceded with the word "a" or "an" should be understood as not excluding plural elements or steps, unless such exclusion is explicitly recited. Furthermore, references to "example embodiment" or "one embodiment" of the present disclosure are not intended to be interpreted as excluding the existence of additional embodiments that also incorporate the recited features.

Network usage events can be associated with payment transactions made using financial transaction cards or payment cards, such as credit cards, debit cards, and prepaid cards. These cards can all be used as a method of payment for performing a transaction. As described herein, the term "financial transaction card" or "payment card" includes cards such as credit cards, debit cards, and prepaid cards, but also includes any other devices that may hold payment account information, such as user computing devices, mobile phones, personal digital assistants (PCAs), and key fobs.

As used herein, "business entity" can refer to a payment processing network, such as the Mastercard® interchange network. Customers of a payment processing network business entity can include merchants, issuers, and acquirers. Network usage data received from the data feeders can include payment-by-card transactions, ensuring clearing and settlement, as well as additional events such as chargeback and dispute resolution between merchants, cardholders, and issuers. Embodiments described herein may relate to a payment card system, such as a credit card payment system using the Mastercard® interchange network. The Mastercard® interchange network is a set of proprietary communications standards promulgated by Mastercard International Incorporated for the exchange of financial transaction data and the settlement of funds between financial institutions that are registered with Mastercard International Incorporated. (Mastercard is a registered trademark of Mastercard International Incorporated located in Purchase, N.Y.).

In a payment card system, a financial institution such as an issuer issues a payment card or electronic payments account identifier, such as a credit card, to a consumer or a cardholder, who uses the payment card to tender payment for a purchase from a merchant. To accept payment with the payment card, the merchant must normally establish an account with a financial institution that is part of the financial payment system. This financial institution is usually called the "merchant bank," the "acquiring bank," or the "acquirer." When the cardholder tenders payment for a purchase with a payment card, the merchant requests authorization from an acquirer for the amount of the purchase. Such a request is referred to herein as an authorization request message (e.g., ISO® 8583 compliant messages and ISO® 20022 compliant messages).

For card-not-present (CNP) transactions, the cardholder provides payment information or billing data associated with the payment card electronically to the merchant. The payment information received by the merchant is stored and transmitted to the acquirer and/or payment processing network as part of an authorization request message. In some embodiments, the merchant transmits a plurality of authorization request messages together as a "batch" file to the acquirer and/or the payment processing network.

Using the payment processing network, computers of the acquirer or merchant processor will communicate with computers of an issuer, to determine whether the cardholder's account is in good standing and whether the purchase is covered by cardholder's available credit line or account balance. Based on these determinations, the request for authorization will be declined or accepted. If the request is accepted, an authorization code is issued to merchant.

A clearing process transfers transaction data related to the purchase among the parties to the transaction, such as an acquirer, payment card processing network, and an issuer. No money is exchanged during the clearing process. Clearing involves the exchange of data required to identify the cardholder account such as the account number, expiration date, billing address, amount of the sale, and/or other transaction identifiers that may be used to identify the transaction. Along with this data, banks in the United States also include a bank network reference number, such as the Banknet Reference Number used by Mastercard International Incorporated, which identifies that specific transaction. When an issuer receives this data, it posts the amount of sale as a draw against the available credit of the cardholder account and prepares to send payment to the acquirer.

For debit card transactions, when a request for a personal identification number (PIN) authorization is approved by the issuer, cardholder account is decreased. Normally, a charge is posted immediately to cardholder account. The payment card association then transmits the approval to the acquiring processor for distribution of goods/services, information, or cash in the case of an automated teller machine (ATM).

After a transaction is authorized and cleared, the transaction is settled among the merchant, acquirer, and issuer. Settlement refers to the transfer of financial data or funds among the merchant's account, the acquirer, and the issuer related to the transaction. Usually, transactions are captured and accumulated into a "batch," which is settled as a group. More specifically, a transaction is typically settled between the issuer and payment processing network, and then between the payment processing network and acquirer, and then between the acquirer and merchant.

All of the network usage events described above, and other similar events, are associated with certain billable events that may be invoiced to one of the participating parties by the payment processing system.

FIG. 1 is an example flow diagram illustrating data flow in an example prior art invoicing process 100 utilized by a business entity, such as a payment processing network, to track customer network usage for invoice generation. Invoicing process 100 determines how much to charge customers (e.g., merchants, acquirers, and issuers) at the end of their billing cycles. In particular, FIG. 1 depicts the flow of network usage data as it is processed for invoicing (e.g., billing). More specifically, invoicing process 100 is defined herein by an invoice preparation process (e.g., pre-billing process) that occurs multiple times throughout a customer's billing cycle, and an invoice generation process (e.g., billing process) that occurs on or near the customer's designated bill run date.

As shown in invoicing process 100, data feeders 102 transmit batch files 150 of raw network usage data to data enrichment module 104 for invoice preparation. The raw network usage data in batch files 150 includes both billable and non-billable usage events. The raw network usage data can include international transaction data. Data feeders 102 are high volume feeding systems that collect raw network usage data and transmit the collected data to data enrichment module 104 for invoice preparation processing. Data feeders 102 can be data feeding applications that each provide different types of network usage data to data enrichment module 104. For example, data feeders 102 can include an authorization data feeder configured to transmit authorization transaction data, a clearing data feeder configured to transmit clearing transaction data, and a debit data feeder configured to transmit debit transaction data.

Data feeders 102 can transmit batch files 150 multiple times throughout the course of a day or just once at the end of the day, for example. Data enrichment module 104 extracts raw network usage data from batch files 150. Data enrichment module 104 validates batch files 150 for format, and performs audit control validations against underlying payment transaction counts and amounts. In some embodiments, batch files 150 can be split into smaller files for multi-processing. In prior art process 100, data enrichment module 104 outputs a number of usage events 152. Customer guide module 106 identifies one or more customers to bill for each usage event 152. For example, customer guide module 106 may identify two customers to bill, such as an issuer and an acquirer, for usage events 152 transmitted from "two sided" data feeders 102. Customer guide module 106 can determine that usage events 152 derived from raw network usage data provided by "two sided" data feeders 102 require billing of no more than two customers. In some embodiments, customer guide module 106 can identify up to five different customers to bill for a given usage event 152. For each identified customer to be billed for usage event 152, a new record is created during processing. Customer guide module 106 outputs customer-identified usage events 154.

In prior art process 100, billing event determination ("BED") module 108 is configured to generate billing events 156 from each customer-identified usage event 154. BED module 108 applies rules to customer-identified usage events 154. Each billing event 156 for which a customer-identified usage event 154 qualifies creates a new record during processing. Criteria tables are utilized by BED module 108 to generate one or more billing events 156 for each customer-identified usage event 154. Criteria tables map certain fields and associated values within a feeder record to a billing event identifier ("billing event ID").

To generate billing events 156, BED module 108 utilizes pointer tables associated with each data feeder 102. A pointer table is a "table of tables" and a feeder transaction (e.g., customer-identified usage event 154) is first compared to rows in the pointer table to determine which criteria table to use. A criteria table is selected when the criteria specified in the pointer table matches some value in the customer-identified usage event 154. The customer-identified usage event 154 is subsequently compared to each row in the selected criteria table. The rows specify criteria intended to match field values in the customer-identified usage event 154. When a match occurs, a billing event ID associated with the matched table and row is returned by BED module 108.

In some embodiments, a final billing event ID requires further processing utilizing additional tables, such as a regional table that specifies a broad geographic region, an intra-country table that specifies countries within that region (for transactions spanning multiple countries), and/or a country table that specifies countries within that region (for transactions not spanning multiple countries). The outputted billing event ID specifies whether a customer-identified usage event 154 is to be billed at a basis quantity, an amount, or both. In some embodiments, after matching all the conditions for a criteria row, customer-identified usage event 154 can, for example, generate up to twenty billing events 156 for each identified customer. On average, the number of transaction records that need to be processed for invoice generation increases after BED module 108 generates billing events 156.

BED module 108 outputs billing events 156 for each customer-identified usage event 154. If there is no customer-specific requirement for application of a rule on a per usage basis, the outputted billing events 156 are aggregated by aggregation module 110. Aggregation module 110 is configured to remove unneeded information from billing events 156, and aggregate like transactions together by billing customer and other key data elements. For example, aggregation module 110 removes billing events 156 that cannot be billed. Aggregation module 110 also removes data from each billing event 156 that is no longer pertinent for the purposes of invoice generation, such as a credit card number used in the underlying transaction. Aggregation module 110 typically has a compression ratio of 150 to 1. At the end of the aggregation process, aggregation module 110 outputs aggregated billing events 160, which are reduced in number and in data content as compared to billing events 156.

However, if a customer-specific requirement dictates that a rule needs to be applied on a per usage basis (e.g., a per usage rule, "PUR"), the outputted billing events 156 cannot be aggregated by aggregation module 110, as data required for application in the PUR would be lost. Thus, as shown in prior art process 100, these unaggregated billing events 162 are transmitted directly to data normalization and rating module 112.

In prior art process 100, billing events 156, including both aggregated and unaggregated billing events 160 and 162, are outputted in a first format that is not compatible with invoice generation ("IG") module 116. Data normalization and rating module 112 reformats billing events 160, 162 into a second format compatible with IG module 116. Data normalization and rating module 112 is also configured to perform a rating process by applying the appropriate billing event rate(s) to billing events 160, 162. The billing event rates are customer specific rates unique to each type of billing event for a specific customer. These customer specific rates are governed by billing agreements between a business entity, such as a payment processing network, and the customer. Data normalization and rating module 112 further derives the appropriate billing date for billing events 160, 162 from the customer criteria, and labels billing events 160,162 with the appropriate billing date. For example, the customer criteria for a given customer can specify which day to bill the customer for specific types of transactions.

Thus, once the rating process is complete, data normalization and rating module 112 outputs rated billing events ("RBEs") 158, 164 identified by a billing date. More specifically, data normalization and rating module 112 outputs aggregated RBEs 158 for aggregated billing events 160 that have been normalized and rated, and unaggregated RBEs 164 for unaggregated billing events 162 that have been normalized and rated. RBEs 158, 164 are saved in pre-billing database 114. Thus, the number of RBEs 158, 164 that are normalized and rated by data normalization and rating module 112, and subsequently stored in pre-billing database 114, is substantially high when unaggregated RBEs 164 are present.

This invoice preparation process is repeated each time data feeders 102 receive a batch of raw network usage data for invoice processing. For example, if raw network usage data is received on a daily basis, RBEs 158,164 are generated and stored each day in pre-billing database 114. In this example, if a payment processing network is billing its customer on a weekly or monthly basis, RBEs 158,164 for each day of the billing cycle are stored in pre-billing database 114, waiting to be billed on the designated bill run date.

On the designated bill run date, IG module 116 performs an invoice generation process to generate a customer invoice. IG module 116 retrieves RBEs 158,164 previously identified with the current billing date from pre-billing database 114. For example, a payment processing network may bill a customer on a weekly basis. In this example, IG module 116 retrieves RBEs 158,164 associated with the customer that were previously labeled with the current billing date for each day of the week. IG module 116 applies billing rules to the retrieved RBEs.

Figure 2:
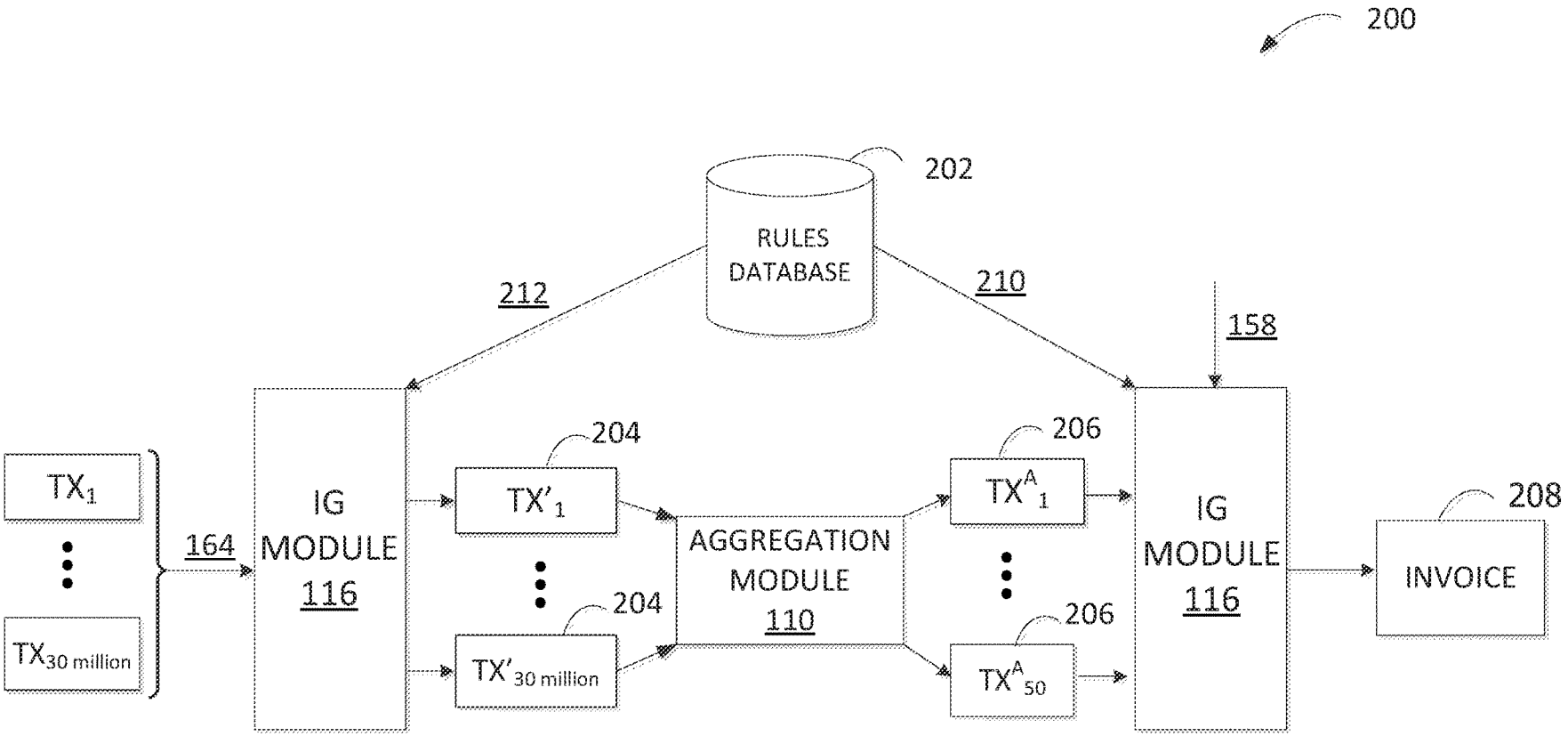
FIG. 2 PRIOR ART

FIG. 2 is a flow diagram illustrating an example prior art invoice generation process 200 applied at IG module 116 using prior art process 100 (shown in FIG. 1). With reference to FIG. 1 and FIG. 2, in particular, prior art invoice generation process 200 illustrates unaggregated RBEs 164 that could not be aggregated by aggregation module 110 during the invoice preparation process described above because a per usage rule ("PUR") is applicable. Invoice generation process 200 is performed by invoice generation ("IG") module 116 on the designated bill run date to generate a customer invoice.

For aggregated RBEs 158, IG module 116 applies invoice generation rules 210 directly. Invoice generation rules 210 include clearing and taxation rules, such as rules associated with a Value Added Tax (VAT), a Goods and Sales Tax (GST), and U.S. Sales Tax at the state and zip code level. During the invoice generation process (e.g., the bill run), IG module 116 also considers customer companion products, such as recurring charges, rebates, and waivers. Invoice generation rules 210 include billing rules that cannot be applied until all of the ratings (RBEs 158,164) for a billing cycle are accounted for. Accordingly, invoice generation rules 210 include rules that need to be applied on the designated bill run date after the billing cycle ends.

Invoice generation rules 210 further include rules that determine whether billed transactions are "flat rated," and thus not re-rated, or tiered based on volume, thus having rates that must be re-calculated at the time of billing because of fluctuating transaction volumes. Each billed transaction is also considered for a number of subtotals. Subtotals are applied across rating and billing and are leveraged to aggregate network usage data for variance checks or reporting. IG module 116 subsequently generates an invoice 208 after applying all the applicable invoice generation rules 210.

IG module 116 retrieves unaggregated RBEs 164 from pre-billing database 114 on the customer's designated bill run date. As illustrated in FIG. 2, because unaggregated RBEs 164 did not undergo an aggregation process prior to being normalized, rated, and stored in pre-billing database 114, the number of RBEs (illustrated as transactions or "TX") that require processing during the invoice generation process can be substantial for some customers. For example, if a customer's billing cycle is 30 days, and a customer-specific rule dictates that a PUR be applied to each billing event on a per usage basis, unaggregated RBEs 164 accumulate for 30 days in pre-billing database 114, waiting to undergo an invoice generation process. If 30 million unaggregated RBEs 164 are accumulated at the end of the 30 day billing cycle, IG module 116 needs to retrieve all 30 million unaggregated RBEs 164 from pre-billing database 114 for invoice generation processing on the bill-run date.

IG module 116 retrieves one or more applicable per usage rules ("PUR") 212 from invoice generation rules database 202, and applies the PURs 212 to each of the 30 million billing events to generate 30 million modified billing events ("MBEs") 204 (illustrated as TX' in FIG. 2). The 30 million MBEs 204 subsequently need to undergo an aggregation process to eliminate unnecessary data and non-billable events. Aggregation module 110 can be configured to perform an aggregation process on the designated bill run date, during the bill run (e.g., invoice generation process), to output aggregated MBEs 206 (illustrated as $TX^A$ in FIG. 2), which are ready for billing.

At this point, IG module 116 is able to apply invoice generation rules 210 from rules database 202, which are billing and invoice rules regularly applied during the invoice generation process to aggregated MBEs 206. IG module 116 applies the retrieved invoice generation rules 210 to aggregated MBEs 206 to generate an invoice 208. Retrieving a substantial number of unaggregated RBEs 164 for processing on the bill-run date can result in significant network delays, reduced data processing speeds, increased errors, and longer bill run times because, in addition to aggregating and applying procedural invoice generation rules 210 that need to be applied during the bill run, PURs 212 also need to be applied to each unaggregated RBE 162 during the bill run. This negatively impacts invoice generation on the billing date because substantially more data is being brought in, and more rules are being applied to high volumes of data on the bill-run date.

Figure 3:
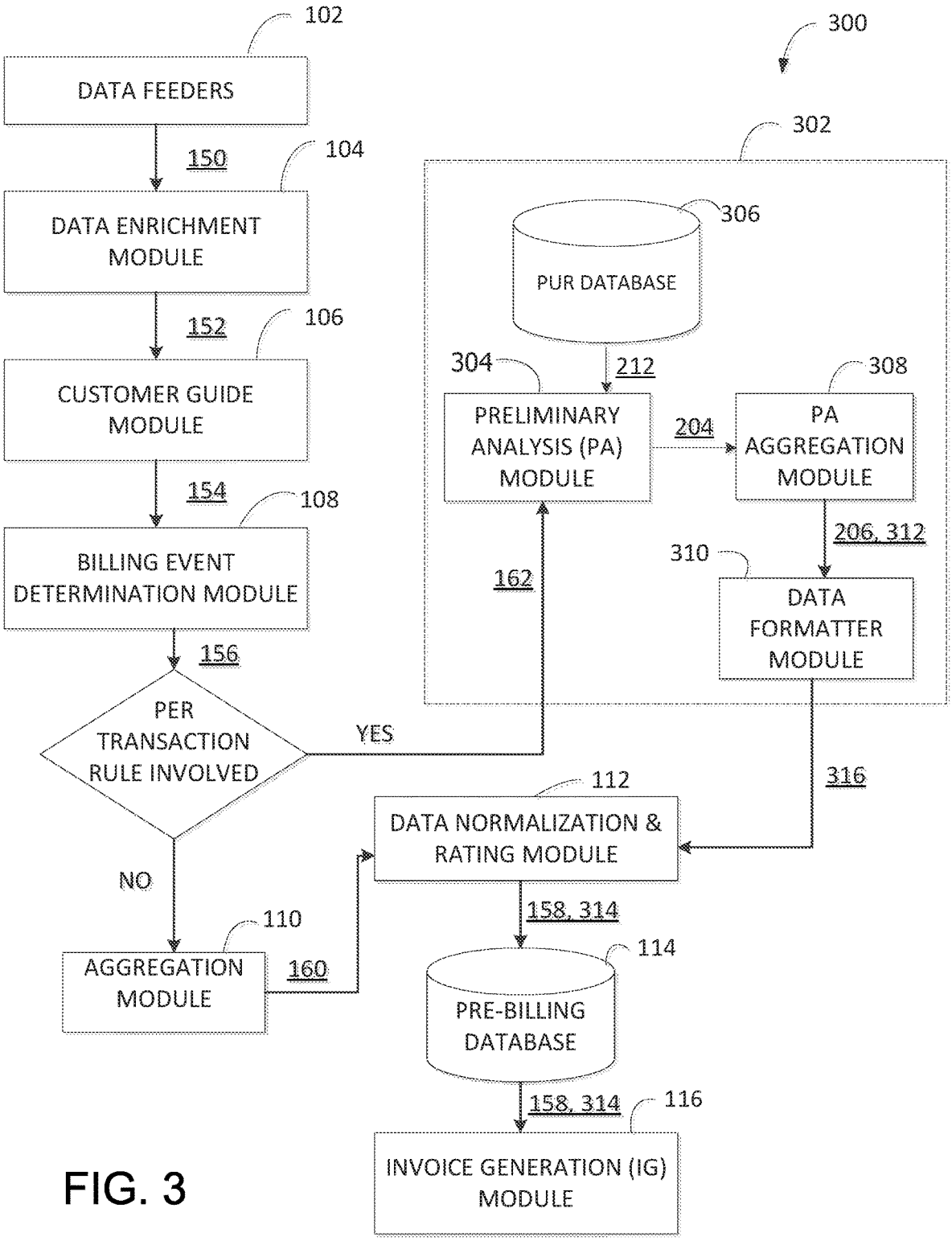

FIG. 3 is a flow diagram illustrating the flow of data through an improved invoicing process 300 in which a preliminary analysis ("PA") process 302 is utilized to process unaggregated billing events 162 prior to normalization and rating. In particular, PA process 302 applies customer-specific per usage rules ("PURs") 212 during the invoice preparation process (e.g., on a first schedule that repeats throughout the billing cycle) rather than only during the invoice generation process (e.g., the bill run) as in prior art systems (see FIGS. 1 and 2). In particular, PA process 302 includes a preliminary analysis ("PA") module 304, a per usage rules ("PUR") database 306, a preliminary analysis ("PA") aggregation module 308 (similar to or the same as aggregation module 110), and a data formatter module 310.

Elements 102, 104, 106, and 108 are substantially as described above. However, in the example embodiment, when one or more PURs 212 are applicable, the unaggregated billing events 162 generated by billing event determination ("BED") module 108 are transmitted to PA module 304 for processing on a separate track from aggregated billing events 160. PA module 304 is configured to determine the type of PUR 212 involved for each unaggregated billing event 162. PA module 304 retrieves the customer-specific PURs 212 needed from PUR database 306. PUR database 306 includes tables associated with each PUR 212, such as a reference table that includes a list of identifiers associated with PURs 212 available for each customer. The reference table specifies which per usage rule to apply for different types of billing events for a given customer. For example, the reference table (not shown) may specify that a specific PUR be applied to billing events that come from authentication transactions, and that another PUR be applied to billing events that come from debit transactions, etc.

PUR database 306 also includes a PUR definition table (not shown) for each PUR. Each PUR definition table can include the PUR as well as details associated with applying each PUR. For example, the PUR definition table can include an identifier associated with the PUR, an identifier associated with the billing event a particular PUR is to be applied for (e.g., "auth" for billing events that come from authorization transactions and "debit" for those that come from debit transactions), the number of files that should be generated for rating (e.g., one rating file or multiple rating files), and/or the identifiers that are assignable to each rating file generated.

In the example embodiment, PA module 304 determines which PUR to apply for each unaggregated billing event 162 by referencing tables provided in PUR database 306. For example, a customer's agreement with the network (e.g., customer criteria) may require that a customer-specific PUR be applied to each unaggregated billing event 162 that comes from authorization transactions. PA module 304 applies the retrieved PUR 212 to the unaggregated billing events 162 received from BED module 108 to generate modified billing events ("MBEs") 204. After at least one customer-specific PUR 212 has been applied, MBEs 204 can subsequently undergo an aggregation process (similar to or the same as the aggregation process described above in FIG. 1) to reduce the total number of MBEs 204 to be billed. PA aggregation module 308 aggregates the MBEs 204 to output aggregated MBEs 206 ready for normalization and rating. In the example embodiment, aggregated MBEs 206 are output in a hash array 312 to facilitate the transfer of aggregated MBEs 206. As described herein, hash array 312 refers to a data structure or an associative array with keyed array items. In alternative embodiments, aggregated MBEs 206 may be output in any suitable format that facilitates the transfer of large amounts of data.

In the example embodiment, data formatter module 310 extracts aggregated MBEs from hash array 312 to generate one or more rating files 316. The one or more rating files 316 includes aggregated MBEs 206 that are formatted for normalization and rating. The one or more rating files 316 are subsequently transmitted to data normalization and rating module 112.

In alternative embodiments, the aggregated MBEs 206 are normalized and rated during PA process 302. In these alternative embodiments, data formatter module 310 outputs aggregated MBEs that have been rated (e.g., rated MBEs 314), and directly transmits the rated MBEs 314 to pre-billing database 114 for storage. Further, in these alternative embodiments, the instructions associated with PURs stored in PUR database 306 govern whether different types of aggregated MBEs are to be normalized and rated during PA process 302.

In the example embodiment, the aggregated MBEs in rating file(s) 316 are normalized and rated by data normalization and rating module 112, which outputs normalized, rated, aggregated MBEs 314 for storage in pre-billing database 114. Accordingly, unlike prior art system 100, PA process 302 enables billing events involving per usage rules to be aggregated during the invoice preparation process multiple times throughout a single billing cycle. By utilizing PA process 302 to apply PURs to unaggregated billing events 162, and subsequently to aggregate the MBEs 204 during the invoice preparation process each time a batch of raw network usage data 150 is received by data feeders 102, the volume of data stored in pre-billing database 114 for processing at the end of each billing cycle is substantially reduced. This in turn reduces the volume of data retrieved by IG module 116 on the designated bill run date, and subsequently reduces the number of rules to be applied as well as the volume of data processed by IG module 116 during the invoice generation process (e.g., bill run).

Figure 4:
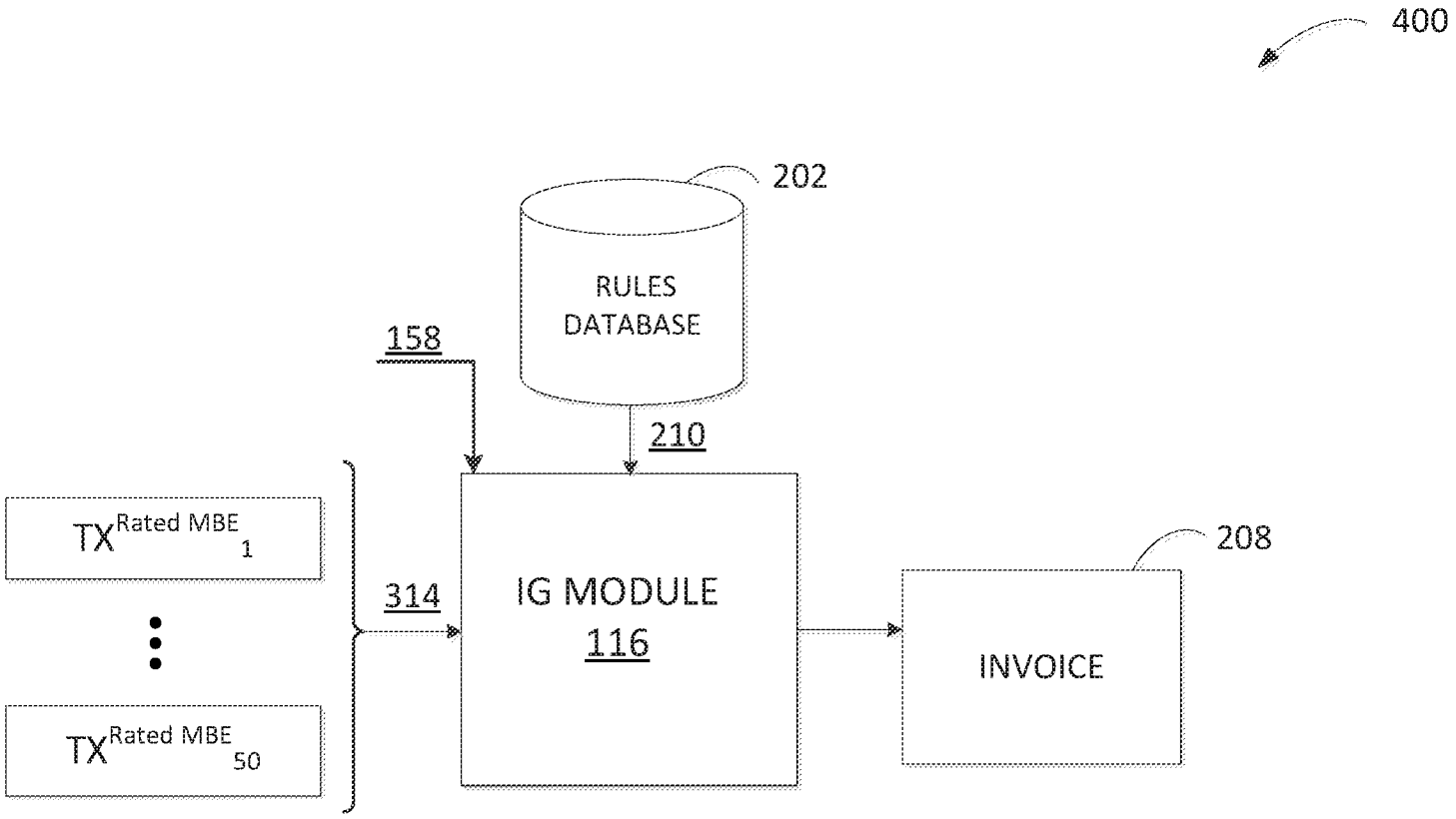

FIG. 4 is a flow diagram illustrating an example invoice generation process 400 applied at IG module 116 that is improved by using preliminary analysis ("PA") process 302 (as shown in FIG. 3). In particular, invoice generation process 400 depicts that utilizing PA process 302 enables IG module 116 to retrieve a reduced volume of network usage data as opposed to prior art systems, such as that of FIG. 2, that do not utilize PA process 302. More specifically, for customers requiring one or more PURs, IG module 116 retrieves a limited number of aggregated and rated MBEs 314, rather than a high volume of unaggregated RBEs 164 that have accumulated over the billing cycle, as shown in FIG. 2. Because rated MBEs 314 are generated by applying one or more applicable PURs each time raw network usage data 150 is received by data feeders 102, a reduced volume of billing events are stored in pre-billing database 114 after aggregation, normalization, and rating. As illustrated in FIGS. 1 and 2, prior art processes, such as process 100, cannot aggregate the unaggregated RBEs 164 each time raw network usage data 150 is received by data feeders 102. For the prior art systems, this results in an accumulation of unaggregated RBEs 164 in pre-billing database 114 that is essentially saved for bulk processing on the designated bill run date. Thus, PA process 302 substantially decreases the data processing time, computational resources, and bandwidth required to apply PURs and invoice generation rules 210 to high volumes of data on the designated bill run date.

As shown in FIG. 4, IG module 116 retrieves and implements only invoice generation rules 210 from rules database 202 during bill run to generate invoice 208. In contrast, in prior art systems, as shown in FIG. 2, a substantial amount of network usage data (as shown by 164, 204, and 206) is processed during the bill run before invoice generation rules 210, can be applied to generate invoice 208. More specifically, rather than retrieving a substantial volume of accumulated network usage data 150 for billing, such as, for example, 30 million unaggregated RBEs 164, IG module 116 retrieves a limited volume of network usage data for the bill run, such as, for example, 50 aggregated and rated MBEs 314, by implementing PA process 302 during the invoice preparation process.

Figure 5:
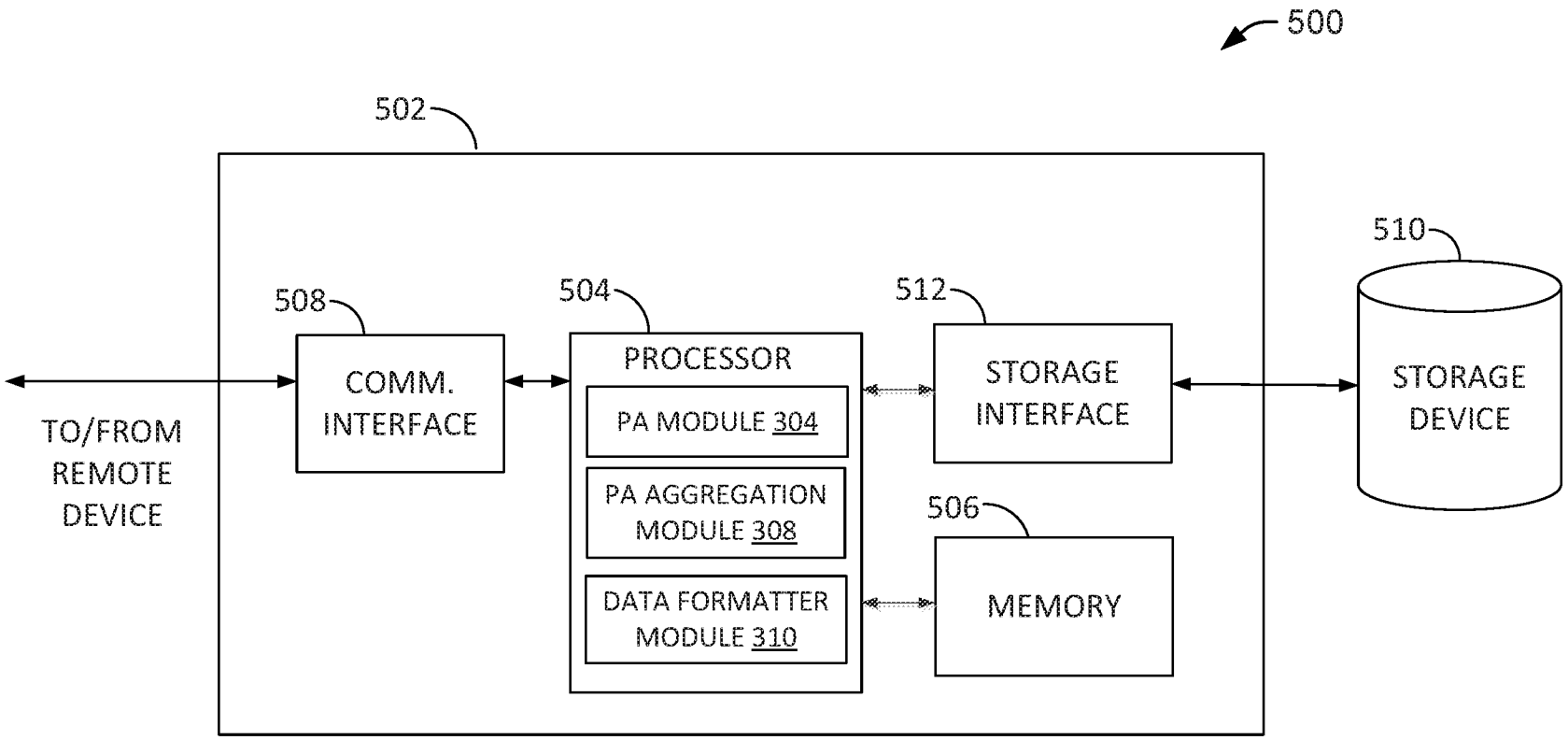

FIG. 5 illustrates an example configuration 500 of a server computing device 502 configured to perform the invoicing process enhanced by preliminary analysis ("PA") process 302, as shown in FIG. 3. Server computing device 502 includes a processor 504 for executing instructions. Instructions may be stored in a memory area 506, for example. Processor 504 may include one or more processing units (e.g., in a multi-core configuration) configured to perform the enhanced invoicing process 300 shown in FIG. 3.

In the example embodiment, processor 504 is operable to execute modules, such as PA module 304, PA aggregation module 308, and data formatter module 310. Modules 304, 308, and 310 may include specialized instruction sets and/or coprocessors. In the example embodiment, PA module 304 is utilized to determine which PUR to apply for each unaggregated billing event 162, and to apply the determined PUR to each unaggregated billing events 162 received from BED module 108 to generate MBEs 204 (all shown in FIG. 3). In the example embodiment, PA aggregation module 308 is utilized to aggregate the generated MBEs 204, and thereby reduce the volume of network usage data to be retrieved for processing on the designated bill run date. Data formatter module 310 may be utilized to format aggregated MBEs 206 for normalization and rating (shown in FIG. 3). In further embodiments, processor 504 also includes IG module 116 (shown in FIG. 3).

Processor 504 is operatively coupled to a communication interface 508 such that server computing device 502 is capable of communicating with a remote device such as one or more rating server computing devices (not shown). For example, communication interface 508 may receive requests to process high volumes of raw network usage data for invoice preparation.

Processor 504 may also be operatively coupled to a storage device 510. Storage device 510 is any computer-operated hardware suitable for storing and/or retrieving data. For example, pre-billing database 114 and/or rules database 202 and/or PUR database 306 may be implemented on storage device 510. In some embodiments, storage device 510 is integrated in server computing device 502. For example, server computing device 502 may include one or more hard disk drives as storage device 510. In other embodiments, storage device 510 is external to server computing device 502 and may be accessed by a plurality of server computing devices 502. For example, storage device 510 may include multiple storage units such as hard disks or solid state disks in a redundant array of inexpensive disks (RAID) configuration. Storage device 510 may include a storage area network (SAN) and/or a network attached storage (NAS) system.

In some embodiments, processor 504 is operatively coupled to storage device 510 via a storage interface 512. Storage interface 512 is any component capable of providing processor 504 with access to storage device 510, such that PA module 304 is capable of communicating with PUR database 306, and IG module 116 (both shown in FIG. 3) is capable of communicating with rules database 202 and pre-billing database 114. Storage interface 512 may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor 504 with access to storage device 510.

Memory area 506 may include, but are not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are for example only, and are thus not limiting as to the types of memory usable for storage of a computer program.

As will be appreciated based on the foregoing specification, the above-described examples of the disclosure may be implemented using computer programming or engineering techniques including computer software, firmware, hardware or any combination or subset thereof. Any such resulting program, having computer-readable code means, may be embodied or provided within one or more computer-readable media, thereby making a computer program product, i.e., an article of manufacture, according to the discussed examples of the disclosure. The computer-readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

The computer programs (also known as programs, software, software applications, "apps", or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The "machine-readable medium" and "computer-readable medium," however, do not include transitory signals. The term "machine-readable signal" refers to any signal used to provide machine instructions and/or data to a programmable processor.

For example, one or more computer-readable storage media may include computer-executable instructions embodied thereon for determining the probability of an authorized transaction resulting in a chargeback. In this example, the computing device may include a memory device and a processor in communication with the memory device, and when executed by said processor the computer-executable instructions may cause the processor to perform a process such as improved invoicing process 300, in which PA process 302 is utilized to process unaggregated billing events 162 prior to normalization and rating, as illustrated in FIG. 3.

The term processor, as used herein, refers to central processing units, microprocessors, microcontrollers, reduced instruction set circuits (RISC), application specific integrated circuits (ASIC), logic circuits, and any other circuit or processor capable of executing the functions described herein.

This written description uses examples to describe embodiments of the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A computer-implemented method for preparing a customer invoice using a computing system comprising at least one processor communicatively coupled to a memory device, the method comprising:

receiving, by the at least one processor, a batch file of usage data on a first schedule, wherein the first schedule repeats a plurality of times before a billing cycle ends;

identifying, by the at least one processor, from the received batch file, a first set of usage events having a first characteristic, wherein the first characteristic requires that a first per usage rule be applied to each usage event of the first set of usage events;

retrieving, by the at least one processor, the first per usage rule from the memory device;

applying, by the at least one processor, the retrieved first per usage rule to each of the first set of usage events;

generating, by the at least one processor based on the application of the retrieved first per usage rule to each of the first set of usage events, modified usage events in accordance with the first schedule;

aggregating, by the at least one processor, the modified usage events, wherein the aggregation reduces a number of modified usage events for billing, thereby reducing an amount of network resources and bandwidth needed to process high volumes of data when the billing cycle ends; and storing, by the at least one processor, the aggregated modified usage events in the memory device in accordance with the first schedule for retrieval when the billing cycle ends.

2. The computer-implemented method of claim 1 further comprising outputting the aggregated modified usage events as a hash array.

3. The computer-implemented method of claim 1 further comprising:

normalizing, by the at least one processor, the aggregated modified usage events; and rating, by the at least one processor, the normalized, aggregated modified usage events, wherein storing the aggregated modified usage events comprises storing the aggregated modified usage events that have been normalized and rated in the memory device.

4. The computer-implemented method of claim 3, wherein normalizing the aggregated modified usage events comprises converting the aggregated modified usage events to a format that is compatible with an invoice generation module, wherein the invoice generation module generates the customer invoice when the billing cycle ends.

5. The computer-implemented method of claim 1, wherein the first per usage rule is specific to a customer, and wherein the first per usage rule is at least one of a custom-specific maximum charge and a custom-specific minimum charge for an underlying network transaction.

6. The computer-implemented method of claim 1, wherein the billing cycle repeats on a second schedule for invoice generation, wherein the first schedule repeats on a daily basis, and wherein the second schedule repeats on a weekly basis.

7. The computer-implemented method of claim 1 further comprising identifying, by the at least one processor, from the received batch file, a second set of usage events having a second characteristic, wherein the second characteristic indicates that no per usage rules are applicable to the second set of usage events.

8. The computer-implemented method of claim 7 further comprising:

aggregating, by the at least one processor, the second set of usage events;

normalizing, by the at least one processor, the aggregated second set of usage events;

rating, by the at least one processor, the normalized aggregated second set of usage events; and storing, by the at least one processor, the rated, normalized, aggregated second set of usage events in the memory device in accordance with the first schedule for retrieval when the billing cycle ends.

9. The computer-implemented method of claim 8, wherein storing the aggregated modified usage events comprises storing the aggregated modified usage events that have been normalized and rated in the memory device, and wherein the method further comprises:

retrieving, by the at least one processor when the billing cycle ends, the rated, normalized, aggregated modified first set of usage events and the rated, normalized, aggregated second set of usage events from the memory device;

applying, by the at least one processor, a plurality of invoice generation rules to the retrieved rated, normalized, aggregated modified first set of usage events and the retrieved rated, normalized, aggregated second set of usage events to generate a customer invoice for the billing cycle; and transmitting, by the at least one processor, the generated customer invoice to a user computing device associated with a customer.

10. A computing system for preparing a customer invoice, the computing system comprising a memory device for storing data and at least one processor communicatively coupled to the memory device, the at least one processor programmed to:

receive a batch file of usage data on a first schedule, wherein the first schedule repeats a plurality of times before a billing cycle ends;

identify, from the received batch file, a first set of usage events having a first characteristic, wherein the first characteristic requires that a first per usage rule be applied to each usage event of the first set of usage events;

retrieve the first per usage rule from the memory device;

apply the retrieved first per usage rule to each of the first set of usage events;

generate, based on the application of the retrieved first per usage rule to each of the first set of usage events, modified usage events in accordance with the first schedule;

aggregate the modified usage events, wherein the aggregation reduces a number of modified usage events for billing, thereby reducing an amount of network resources and bandwidth needed to process high volumes of data when the billing cycle ends; and store the aggregated modified usage events in the memory device in accordance with the first schedule for retrieval when the billing cycle ends.

11. The computer system of claim 10, wherein the at least one processor is further programmed to:

normalize the aggregated modified usage events; and rate the normalized, aggregated modified usage events, wherein storing the aggregated modified usage events comprises storing the aggregated modified usage events that have been normalized and rated in the memory device.

12. The computer system of claim 11, wherein the at least one processor is further programmed to normalize the aggregated modified usage events by converting the aggregated modified usage events to a format that is compatible with an invoice generation module, wherein the invoice generation module generates the customer invoice when the billing cycle ends.

13. The computer system of claim 10, wherein the first per usage rule is specific to a customer, and wherein the first per usage rule is at least one of a custom-specific maximum charge and a custom-specific minimum charge for an underlying network transaction.

14. The computer system of claim 10, wherein the at least one processor is further programmed to identify, from the received batch file, a second set of usage events having a second characteristic, wherein the second characteristic indicates that no per usage rules are applicable to the second set of usage events.

15. The computer system of claim 14, wherein the at least one processor is further programmed to:

aggregate the second set of usage events;

normalize the aggregated second set of usage events;

rate the normalized aggregated second set of usage events; and store the rated, normalized, aggregated second set of usage events in the memory device in accordance with the first schedule for retrieval when the billing cycle ends.

16. The computer system of claim 15, wherein the at least one processor is programmed to store the aggregated modified usage events by storing the aggregated modified usage events that have been normalized and rated in the memory device the at least one processor, and wherein the at least one processor is further programmed to:

retrieve, from the memory device when the billing cycle ends, the rated, normalized, aggregated modified first set of usage events and the rated, normalized, aggregated second set of usage events;

apply a plurality of invoice generation rules to the retrieved rated, normalized, aggregated modified first set of usage events and the retrieved rated, normalized, aggregated second set of usage events to generate a customer invoice for the billing cycle; and transmit the generated customer invoice to a user computing device associated with a customer.

17. At least one non-transitory computer-readable storage media that includes computer-executable instructions for preparing a customer invoice, wherein when executed by a computing device including at least one processor coupled to a memory device, the computer-executable instructions cause the computing device to:

receive a batch file of usage data on a first schedule, wherein the first schedule repeats a plurality of times before a billing cycle ends;

identify, from the received batch file, a first set of usage events having a first characteristic, wherein the first characteristic requires that a first per usage rule be applied to each usage event of the first set of usage events;

retrieve the first per usage rule from the memory device;

apply the retrieved first per usage rule to each of the first set of usage events;

generate, based on the application of the retrieved first per usage rule to each of the first set of usage events, modified usage events in accordance with the first schedule;

aggregate the modified usage events, wherein the aggregation reduces a number of modified usage events for billing, thereby reducing an amount of network resources and bandwidth needed to process high volumes of data when the billing cycle ends; and store the aggregated modified usage events in the memory device in accordance with the first schedule for retrieval when the billing cycle ends.

18. The at least one non-transitory computer-readable storage media of claim 17, wherein the computer-executable instructions further cause the computing device to identify, from the received batch file, a second set of usage events having a second characteristic, wherein the second characteristic indicates that no per usage rules are applicable to the second set of usage events.

19. The at least one non-transitory computer-readable storage media of claim 18, wherein the computer-executable instructions further cause the computing device to:

aggregate the second set of usage events;

normalize the aggregated second set of usage events;

rate the normalized aggregated second set of usage events; and store the rated, normalized, aggregated second set of usage events in the memory device in accordance with the first schedule for retrieval when the billing cycle ends.

normalize the aggregated modified usage events; and rate the normalized, aggregated modified usage events, wherein storing the aggregated modified usage events comprises storing the aggregated modified usage events that have been normalized and rated in the memory device.

20. The at least one non-transitory computer-readable storage media of claim 19, wherein storing the aggregated modified usage events comprises storing the aggregated modified usage events that have been normalized and rated in the memory device, and wherein the computer-executable instructions further cause the computing device to:

retrieve, from the memory device when the billing cycle ends, the rated, normalized, aggregated modified first set of usage events and the rated, normalized, aggregated second set of usage events;

apply a plurality of invoice generation rules to the retrieved rated, normalized, aggregated modified first set of usage events and the retrieved rated, normalized, aggregated second set of usage events to generate a customer invoice for the billing cycle; and transmit the generated customer invoice to a user computing device associated with a customer.

21. A computer-implemented method for preparing a customer invoice using a computing system comprising at least one processor communicatively coupled to a memory device, the method comprising:

receiving, by the at least one processor, a batch file of usage data on a first schedule, wherein the first schedule repeats a plurality of times before a billing cycle ends;

identifying, by the at least one processor, from the received batch file, a first set of usage events having a first characteristic, wherein the first characteristic requires that a first per usage rule be applied to each usage event of the first set of usage events;

retrieving, by the at least one processor, the first per usage rule from the memory device;

applying, by the at least one processor, the retrieved first per usage rule to each of the first set of usage events to generate modified usage events in accordance with the first schedule;

aggregating, by the at least one processor, the modified usage events, wherein the aggregation reduces a number of modified usage events for billing;

normalizing, by the at least one processor, the aggregated modified usage events, wherein normalizing the aggregated modified usage events comprises converting the aggregated modified usage events to a format that is compatible with an invoice generation module, and wherein the invoice generation module generates the customer invoice when the billing cycle ends;

rating, by the at least one processor, the normalized, aggregated modified usage events; and storing, by the at least one processor, the aggregated modified usage events in the memory device in accordance with the first schedule for retrieval when the billing cycle ends, wherein storing the aggregated modified usage events comprises storing the aggregated modified usage events that have been normalized and rated in the memory device.

22. A computing system for preparing a customer invoice, the computing system comprising a memory device for storing data and at least one processor communicatively coupled to the memory device, the at least one processor programmed to:

receive a batch file of usage data on a first schedule, wherein the first schedule repeats a plurality of times before a billing cycle ends;

identify, from the received batch file, a first set of usage events having a first characteristic, wherein the first characteristic requires that a first per usage rule be applied to each usage event of the first set of usage events;

retrieve the first per usage rule from the memory device;

apply the retrieved first per usage rule to each of the first set of usage events to generate modified usage events in accordance with the first schedule;

aggregate the modified usage events, wherein the aggregation reduces a number of modified usage events for billing;

normalize the aggregated modified usage events by converting the aggregated modified usage events to a format that is compatible with an invoice generation module, wherein the invoice generation module generates the customer invoice when the billing cycle ends;

rate the normalized, aggregated modified usage events; and store the aggregated modified usage events in the memory device in accordance with the first schedule for retrieval when the billing cycle ends, wherein storing the aggregated modified usage events comprises storing the aggregated modified usage events that have been normalized and rated in the memory device.

* * * * *